US009235229B2

(12) United States Patent
Zhang

(10) Patent No.: US 9,235,229 B2
(45) Date of Patent: Jan. 12, 2016

(54) LOW POWER FAST SETTLING VOLTAGE REFERENCE CIRCUIT

(75) Inventor: Junmou Zhang, Chandler, AZ (US)

(73) Assignee: NXP B.V., Eindhoven (NL)

( * ) Notice: Subject to any disclaimer, the term of this patent is extended or adjusted under 35 U.S.C. 154(b) by 406 days.

(21) Appl. No.: 13/619,202

(22) Filed: Sep. 14, 2012

(65) Prior Publication Data

US 2014/0077791 A1 Mar. 20, 2014

(51) Int. Cl.
*G05F 3/16* (2006.01)
*G05F 3/30* (2006.01)

(52) U.S. Cl.
CPC ..... *G05F 3/30* (2013.01)

(58) Field of Classification Search
CPC ..... G05F 3/30
USPC ..... 323/312, 313, 314, 315, 316; 327/539, 327/540, 541, 542, 543
See application file for complete search history.

(56) References Cited

U.S. PATENT DOCUMENTS 6,150,872 A * 11/2000 McNeill et al. ..... 327/539
7,224,209 B2 * 5/2007 Hsu ..... G05F 3/30 323/312
7,286,002 B1 * 10/2007 Jackson ..... 327/539
7,602,236 B2 * 10/2009 Jo ..... 327/539
7,911,195 B2 * 3/2011 Draxelmayr ..... 323/313
8,008,966 B2 * 8/2011 Cho ..... 327/539
8,080,989 B2 * 12/2011 Jo ..... 323/313
8,344,720 B2 * 1/2013 Nag et al. ..... 323/316
2005/0040807 A1 2/2005 Chen
2005/0151528 A1 7/2005 Marinca
2007/0164722 A1 7/2007 Rao
2010/0164468 A1 7/2010 Dix
2011/0068766 A1 * 3/2011 Nag et al. ..... 323/313

FOREIGN PATENT DOCUMENTS

CN 102073332 A 5/2011
JP 2005332164 A 12/2005

* cited by examiner

*Primary Examiner* — Adolf Berhane
*Assistant Examiner* — Afework Demisse

(57) ABSTRACT

Embodiments of a voltage reference circuit are described. In one embodiment, a voltage reference circuit includes a startup circuit configured to generate a startup current and to be turned off in response to a comparison between the startup current and a current threshold, an amplifier connected to the startup circuit and configured to generate an amplified current using a positive current feedback loop in response to the startup current, and a proportional to absolute temperature (PTAT) current generator configured to generate a temperature-independent reference voltage in response to the startup current and the amplified current. Other embodiments are also described.

19 Claims, 6 Drawing Sheets

LOW POWER FAST SETTLING VOLTAGE REFERENCE CIRCUIT

A semiconductor device typically has a built-in voltage reference circuit to provide a reference voltage for miscellaneous blocks of the semiconductor device. For example, voltage reference circuits are extensively used in analog Integrated Circuits (ICs). Occasionally, an analog IC even uses more than one voltage reference circuit to provide multiple reference voltages. Voltage reference circuits are often required in digital ICs for oscillation and clock generation. Voltage reference circuits are essential building blocks for modern semiconductor devices and performance of the voltage reference circuits, such as power consumption and voltage accuracy, can affect the total performance of the semiconductor devices.

A semiconductor device typically operates in at least a "standby" mode and a "normal function" mode. Operating in the "standby" mode, the semiconductor device saves power by shutting down active circuit components. Operating in the "normal function" mode, the semiconductor device exhibits increased power consumption while it processes information using active circuit components. Typical applications require a semiconductor device to wake up from the "standby" mode and to send back information within a short time period. For example, a temperature application may require a temperature sensing circuit to wake up, measure the ambient temperature, and quickly send back temperature information, for example on the order of 1 microsecond. Typical steps for a digital circuit to wake up from the "standby" mode include starting up a voltage reference circuit to enable an oscillator, generating oscillator clock signals for the operation of the digital circuit, enabling other blocks to process information, and sending the information to another device. The startup time of the voltage reference circuit is critical for the response time of a semiconductor device. To reduce the response time of a semiconductor device, the startup time of the voltage reference circuit needs to be minimized.

In addition to minimizing the startup time of a voltage reference circuit, the current consumption of the voltage reference circuit should also be kept low, in particular, for applications such as portable devices. However, the goals of a rapid startup time and low current consumption can conflict with each other because a relatively large current helps to speed voltage settling of the voltage reference circuit.

Embodiments of a voltage reference circuit are described. In one embodiment, a voltage reference circuit includes a startup circuit configured to generate a startup current and to be turned off in response to a comparison between the startup current and a current threshold, an amplifier connected to the startup circuit and configured to generate an amplified current using a positive current feedback loop in response to the startup current, and a proportional to absolute temperature (PTAT) current generator configured to generate a temperature-independent reference voltage in response to the startup current and the amplified current. Other embodiments are also described.

In an embodiment, a voltage reference circuit includes a startup circuit, an operational amplifier, and a PTAT current generator. The startup circuit is configured to generate a startup current and to be turned off in response to a comparison between the startup current and a current threshold. The startup circuit includes a current source configured to generate a source current when no current flows through the voltage reference, a current comparator configured to generate the startup current in response to the source current, and a switch connected to the current comparator. The current comparator is further configured to turn off the switch in response to the comparison between the startup current and the current threshold. The operational amplifier is connected to the startup circuit and is configured to generate an amplified current using a positive current feedback loop in response to the startup current. The operational amplifier includes a differential input stage connected to the startup circuit and an output stage connected to the differential input stage. The differential input stage and the output stage form the positive current feedback loop in which a spike in a current that flows through the different input stage causes a further increase of the current beyond the spike. The PTAT current generator is configured to generate a temperature-independent reference voltage in response to the startup current and the amplified current.

In an embodiment, a bandgap voltage reference circuit includes a startup circuit, an operational amplifier, and a PTAT current generator. The startup circuit is configured to generate a startup current and to be turned off in response to a comparison between the startup current and a current threshold. The operational amplifier is connected to the startup circuit and is configured to generate an amplified current using a positive current feedback loop in response to the startup current. The operational amplifier includes a differential input stage connected to the startup circuit and an output stage connected to the differential input stage. The differential input stage and the output stage form the positive current feedback loop in which a spike in a current that flows through the different input stage causes a further increase of the current beyond the spike. The PTAT current generator is configured to generate a temperature-independent reference voltage in response to the startup current and the amplified current.

Other aspects and advantages of embodiments of the present invention will become apparent from the following detailed description, taken in conjunction with the accompanying drawings, depicted by way of example of the principles of the invention.

Throughout the description, similar reference numbers may be used to identify similar elements.

Figure 1:
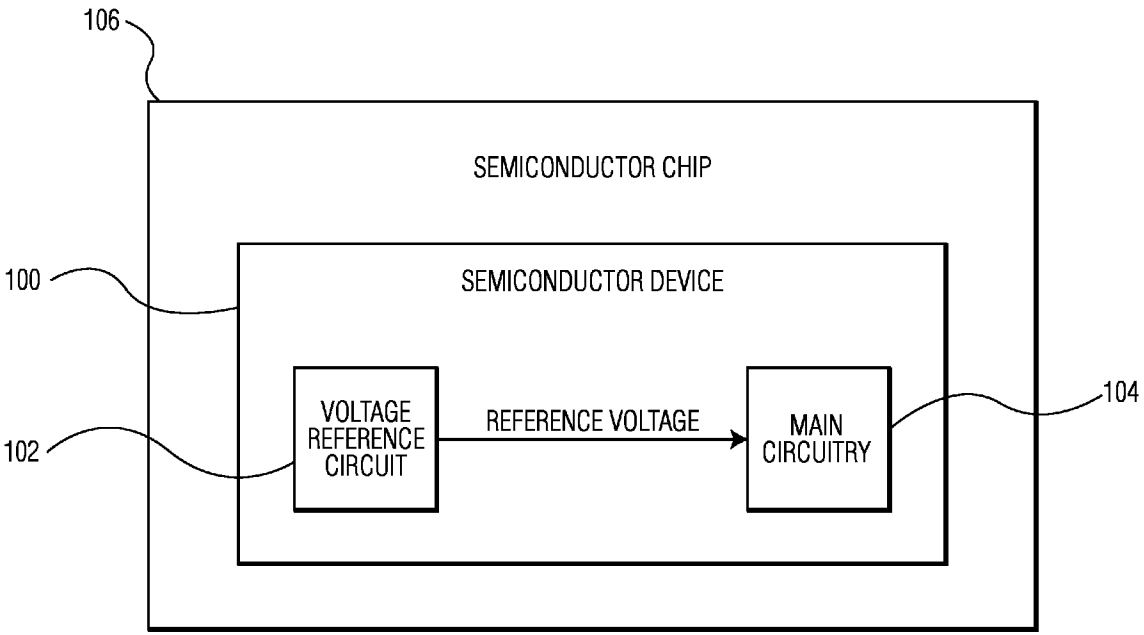
FIG. 1 is a schematic block diagram of a semiconductor device in accordance with an embodiment of the invention.

It will be readily understood that the components of the embodiments as generally described herein and illustrated in the appended figures could be arranged and designed in a wide variety of different configurations. Thus, the following detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

A PNP bipolar device can be used as a low-cost voltage reference circuit. Junction voltages of a PNP bipolar device under different bias currents can be used to generate a temperature-independent reference voltage. Such an architecture is also referred to as a bandgap voltage reference circuit because its output voltage typically is 1.23V, which is similar to the value of the valence band. However, the typical startup time of a bipolar bandgap circuit is in the range of hundreds of microseconds (μs), which is unsuitable for applications with stringent timing requirements.

FIG. 1 is a schematic block diagram of a semiconductor device 100 in accordance with an embodiment of the invention. The semiconductor device may be a semiconductor circuit, such as, a digital circuit. In the embodiment depicted in FIG. 1, the semiconductor device includes a voltage reference circuit 102 and main circuitry 104. The semiconductor device can be implemented in a substrate, such as a semiconductor wafer or a printed circuit board (PCB). In an embodiment, the semiconductor device is packaged in a semiconductor IC chip 106 and included in a computing device, such as a smartphone, a tablet computer, a laptop, etc.

The voltage reference circuit 102 of the semiconductor device 100 is configured to generate at least one reference voltage for the main circuitry 104. In one embodiment, the semiconductor device is a power management IC and the voltage reference circuit 102 provides a reference voltage to voltage regulation and current biasing components of the power management IC. In another embodiment, the semiconductor device is a digital clock IC and the voltage reference circuit 102 provides a reference voltage to oscillation and clock generation components of the digital clock IC. Although the semiconductor device is shown in FIG. 1 as including one voltage reference circuit, in other embodiments, the semiconductor device may include multiple voltage reference circuits that generate more than one reference voltage for different blocks of the semiconductor device.

In addition to the reference voltage, the voltage reference circuit 102 can generate a reference current based on the reference voltage. In some embodiments, a separate current reference circuit is used to generate a reference current based on the reference voltage. Performance of an electric circuit that operates based on the reference voltage and the reference current is dependent on the accuracy of the reference voltage and the reference current. For example, the reference voltage and the reference current can be used by an oscillator for the generation of oscillation signals. In the oscillator, the accuracy of the oscillation signals is largely dependent on the accuracy of the reference voltage and the reference current input into the oscillator.

The main circuitry 104 of the semiconductor device 100 includes circuit components that perform one or more functions of the semiconductor device. For example, the main circuitry may include voltage regulation and current biasing circuit components, oscillation and clock generation circuit components, or timekeeping circuit components that perform timekeeping functions, such as generating a current time value, storing the current time value and other parameters, and communicating with external entities.

Figure 2:
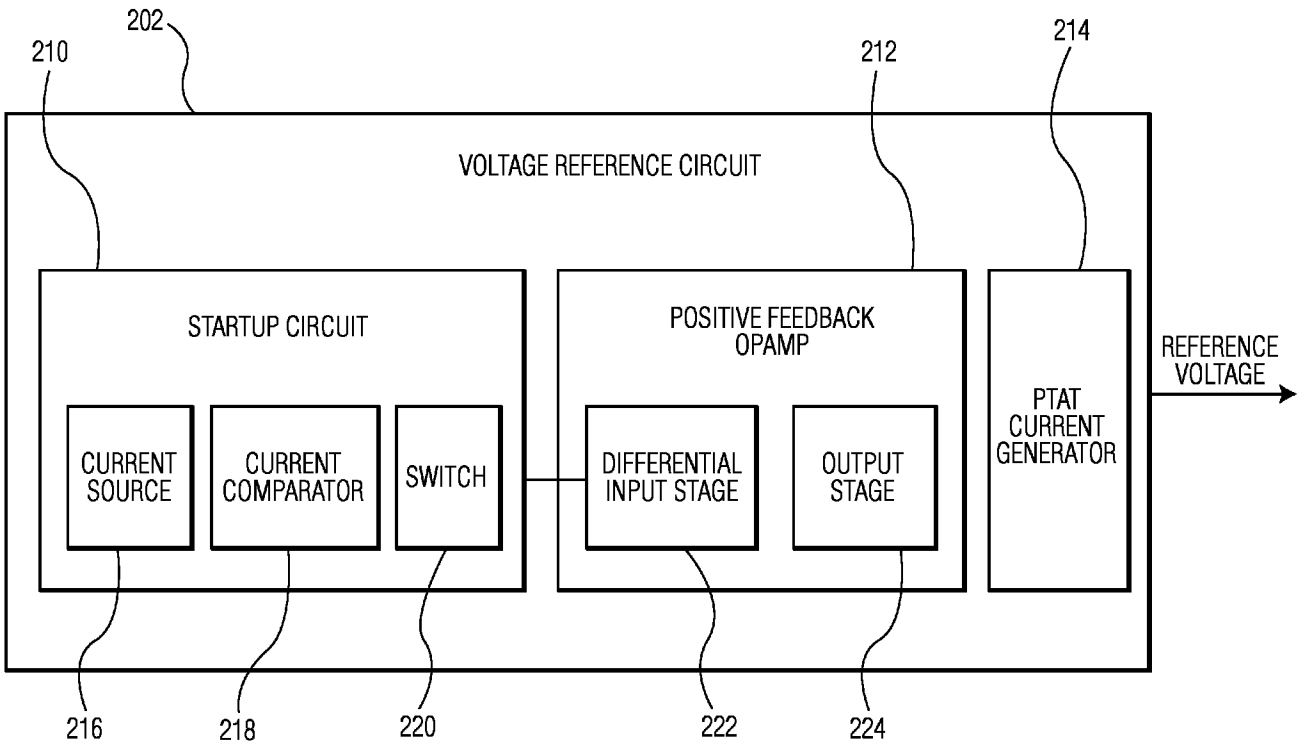
FIG. 2 depicts an embodiment of the voltage reference circuit in FIG. 1.

FIG. 2 depicts an embodiment of the voltage reference circuit 102 depicted in FIG. 1. In the embodiment depicted in FIG. 2, a voltage reference circuit 202 includes a startup circuit 210, an amplifier 212, and a proportional to absolute temperature (PTAT) current generator 214 configured to generate a reference voltage that is temperature independent. In one embodiment, the startup circuit 210, the amplifier 212, and the PTAT current generator 214 are connected to a power supply voltage and to a lower voltage, such as, ground. The voltage reference circuit 202 can generate a reference voltage from less than one volt up to tens of volts. In an embodiment, the voltage reference circuit 202 is a bandgap circuit that generates a bandgap voltage of around 1.23V.

The startup circuit 210 is configured to generate a startup current and to be turned off in response to a comparison between the startup current and a current threshold. Because the startup circuit 210 is turned off in response to the comparison between the startup current and the current threshold, the power consumption of the startup circuit 210 is reduced. In the embodiment depicted in FIG. 2, the startup circuit 210 includes a current source 216 configured to generate a source current when no current flows through the voltage reference, a current comparator 218 configured to generate the startup current in response to the source current, and a switch 220 connected to the current comparator 218. The current comparator 218 is configured to turn off the switch 220 in response to the comparison between the startup current and a current threshold.

In one embodiment, the current comparator 218 includes a trigger transistor having a gate terminal that is connected to the switch 220, gate terminals of transistors of the PTAT current generator 214, and gate terminals of transistors of the amplifier 212. Because the gate terminal of the trigger transistor is connected to the gate terminals of the transistors of the PTAT current generator 214, and the gate terminals of the transistors of the amplifier 212, the voltages of the transistors of the PTAT current generator 214 and the amplifier 212 can be set through the trigger transistor, and consequently, forcing the voltage reference circuit 302 into a desired working state. In this embodiment, the switch 220 may include a transistor having a gate terminal that is connected to a source terminal or a drain terminal of the trigger transistor of the current comparator 218.

In one embodiment, the current source 216 includes a first set of transistors that is connected in series, the current comparator 218 includes a second set of transistors that is connected in series, and the switch 220 includes a switching transistor. In this embodiment, the second set of transistors may include a trigger transistor and at least one transistor connected to a drain terminal or a source terminal of the trigger transistor and a gate terminal of the switching transistor. In addition, a gate terminal of the trigger transistor may be connected to a drain terminal or a source terminal of the switching transistor, gate terminals of a number of transistors of the PTAT current generator 214, and gate terminals of a number of transistors of the amplifier 212.

The amplifier 212 is connected to the startup circuit 210 and configured to generate an amplified current using a positive current feedback loop in response to the startup current. In the embodiment depicted in FIG. 2, the amplifier 212 is a positive feedback operational amplifier (OPAMP) that includes a differential input stage 222 connected to the startup circuit 210 and an output stage 224 connected to the differential input stage 222. The differential input stage 222 and the output stage 224 form the positive current feedback loop in which a spike in a current that flows through the differential input stage 222 causes a further increase of the current beyond the spike. Because the amplifier 212 amplifies the startup current using a positive current feedback loop, the amplification speed of the startup current is increased and, consequently, the settling time of the voltage reference circuit 202 is reduced.

In one embodiment, the differential input stage 222 includes a differential input pair of transistors. A drain current of the differential input pair of transistors is exponentially related to a gate-source voltage difference of the differential input pair of transistors. In one embodiment, the output stage 224 includes a diode-connected transistor, and a drain terminal of the diode-connected transistor is connected (e.g., directly connected) to a gate terminal of the diode-connected transistor. In this embodiment, the gate terminal of the diode-connected transistor may be connected to gate terminals of a number of transistors of the PTAT current generator 214 and a gate terminal of a transistor of the differential input stage 212, and the current that flows through the differential input stage may be a bias current of the transistor of the differential input stage 212. In this embodiment, the PTAT current generator 214 may further include a number of bipolar devices that are connected to the transistors of the PTAT current generator 214.

The voltage reference circuit 202 can generate a temperature-independent reference voltage with a fast startup/settling time and a low current consumption. In an example of an operation of the voltage reference circuit 202, the startup circuit 210 generates a startup current and is turned off in response to a comparison between the startup current and a current threshold. Because the startup circuit 210 is turned off in response to the comparison, the power consumption of the startup circuit 210 can be kept low. In response to the startup current, the amplifier 212 generates an amplified current using a positive current feedback loop. Because the amplifier 212 amplifies the startup current using the positive current feedback loop, the amplification speed of the startup current is increased and, consequently, the startup/settling time of the voltage reference circuit 202 is reduced. In response to the startup current and the amplified current, the PTAT current generator 214 generates a temperature-independent reference voltage.

Figure 3:
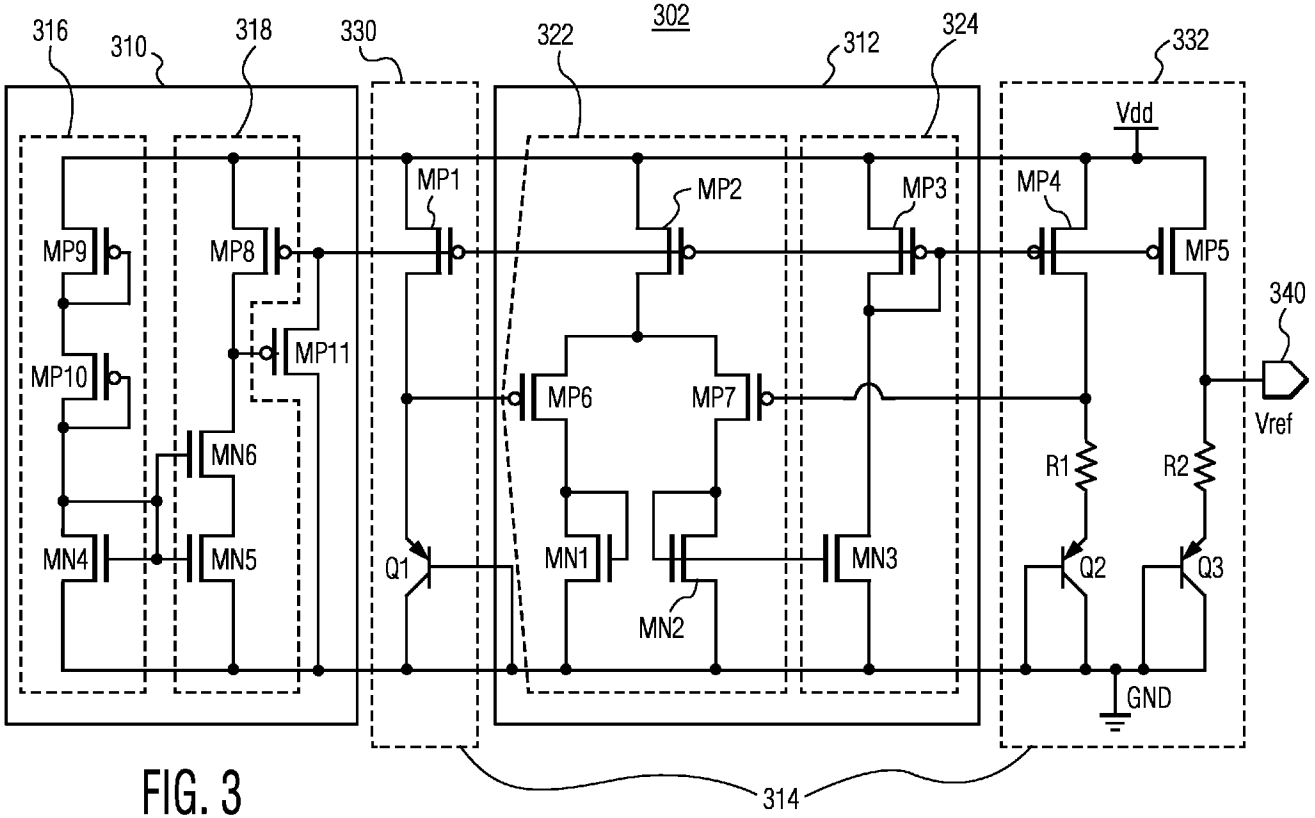
FIG. 3 depicts an embodiment of the voltage reference circuit shown in FIG. 2.

FIG. 3 depicts an embodiment of the voltage reference circuit 202 depicted in FIG. 2. In the embodiment depicted in FIG. 3, a voltage reference circuit 302 includes a startup circuit 310, a positive feedback OPAMP 312, and a PTAT current generator 314, which are connected to a positive voltage, "Vdd," and the ground, "GND." The voltage reference circuit 302 generates a reference voltage, "Vref," at an output terminal 340.

The startup circuit 310 includes a current source 316 that includes PMOS transistors, "MP9," "MP10," and an NMOS transistor, "MN4," a current comparator 318 that includes a PMOS transistor, "MP8," and NMOS transistors, "MN5" and "MN6," and an PMOS transistor, "MP11," which acts as a switch.

In an example of an operation of the startup circuit 310, the current source 316, which is formed by the transistors, MP9, MP10, and MN4, generates a current. The current generated by the current source 316 is mirrored to the transistors, MN5, MN6. When the startup circuit 310 is in a state where there is no current (i.e., no current flows through the transistors, MN5, MN6), the transistor, MP8, is closed and no current flows through the transistor, MP8. Because no current flows through the transistor, MP8, the voltage at the gate terminal of the transistor, MP11, is pulled down by the transistors, MN5, MN6, which turns on the transistor, MP11. After the transistor, MP11, is turned on, the voltages at the gate terminals of the transistors, MP1, MP2, MP3, MP4, MP5, MP8, are pulled low by the transistor, MP11, causing currents to be injected into the bipolar transistors Q1, Q2, Q3, and the OPAMP 312, and forcing the voltage reference circuit 302 into a desired working state. The transistors, MP8, MN6, MN5, form the current comparator 318. When the voltage at the gate terminal of the transistor, MP8, is pulled down by the transistor, MP11, to a level that is lower than its threshold voltage, the transistor, MP8, is turned on. When the current that flows through the transistor, MP8, is larger than the current that flows through the transistors, MN5, MN6, the voltage at the gate terminal of the transistor, MP11, increases, which causes the transistor, MP11, to shut off. In an embodiment, the startup circuit 310 only consumes about 49 nano-amperes (nA). In particular, the current source 316 generates a current of about 45 nA and the current comparator 318 consumes a current of about 4 nA.

The positive feedback OPAMP 312 includes a differential input stage 322, which includes PMOS transistors "MP2," "MP6," "MP7," and NMOS transistors "MN1," "MN2," and an output stage 324, which includes a PMOS transistor, "MP3," and an NMOS transistor, "MN3." The transistor, MP3, is a diode-connected transistor in which the drain terminal and the gate terminal are connected together to form a diode connection. In one embodiment, the OPAMP 312 consumes a low current of about 0.54 μA.

The OPAMP 312 achieves a fast settling time of the reference voltage (e.g., the bandgap voltage) with a positive current feedback. In an example of an operation of the positive feedback OPAMP 312, an increase on the bias current of the transistor, MP2, causes the voltage at the gate terminal of the transistor, MN2, to increase. The increase of the voltage at the gate terminal of the transistor, MN2, leads to an increase in the current that flows through the transistor, MN3. Because the current that flows through the transistor, MP3, is mirrored to the transistor, MP2, the current that flows through the transistor, MP2, increases with the increase in the current that flows through the transistor, MN3. This completes the positive feedback loop in which a positive spike in the current that flows through the transistor, MP2, causes further increase of the current in the transistor, MP2 beyond the spike.

The transistors, MP6, MP7, of the differential input stage 322 forms a differential input pair. In the embodiment depicted in FIG. 3, the differential input pair is biased at a low current to minimize the power consumption of the positive feedback OPAMP 312. In an embodiment, the differential input pair is biased at a current of 90 nA. However, one side benefit of biasing the differential input pair at a low current is a low offset of the OPAMP 312. Because the transistors, MP6, MP7, have a large width to length (W/L) ratio and are biased at a low current, the transistors, MP6, MP7, are working in the "weak inversion" region, where the drain current, "$I_D$," of a transistor, MP6 or MP7, has an exponential relationship to the gate-source voltage difference, "Vgs," which is the voltage difference between gate and source terminals of the transistor. In one embodiment, the drain current, $I_D$, and the gate-source voltage, Vgs, satisfy the expression:

$$I_D = I_O e^{\frac{V_{gs}}{\varepsilon V_T}}, \tag{1}$$

where $I_0$ represents the saturation current when one of the transistors, MP6, MP7, is biased in saturation, $\epsilon$ is the non-ideality factor, and $V_T$ is equal to "kT/q," where q represents the magnitude of the electrical charge on the electron, which is a constant equal to $1.602\times10^{-19}$, k represents the Boltzmann constant, and T represents the operation temperature in degrees Kelvin. Because the drain current, $I_D$, is exponentially related to the gate-source voltage, Vgs, the conductance of the transistors, MP6, MP7, is large, which leads to a small OPAMP offset. The drain terminal of the transistor, MN3, has an impedance of "1/gm," where, "gm," is the conductance of the transistor, MP3. In the embodiment depicted in FIG. 3, the transistor, MP3, is a diode-connected transistor in which the gate terminal of the transistor, MP3, is connected to the source terminal of the transistor, MP3. Because the gate and source terminals of the transistor, MP3, are connected, a node of low impedance of, 1/gm, at the gate terminals of the transistors, MP1-MP5, is created. A low impedance of, 1/gm, can greatly accelerate the startup of the voltage reference circuit 302.

The PTAT current generator 314 includes PMOS transistors "MP1," "MP4," "MP5," bipolar transistors "Q1," "Q2," "Q3," and resistors, "R1," "R2." In the embodiment depicted in FIG. 3, the transistors, MP1, Q1, form a first PTAT current generation section 330 while the transistors, MP4, MP5, Q2, Q3, and the resistors, R1, R2, form a second PTAT current generation section 332. The bipolar transistors, Q1-Q3, are diode-connected transistors. The dimension of the transistor, Q2, is a multiple of the dimension of the transistor, Q1. In an embodiment, the size of the transistor, Q2, is five times of the size of the transistor, Q1. The dimension of the transistor, Q1, is similar to or the same as the dimension of the transistor, Q3.

In an example of an operation of the PTAT current generator 314, the same currents are forced into the transistors, Q1, Q2, and a junction voltage difference, "ΔVbe," is generated between the transistors, Q1, Q2. The junction voltage, ΔVbe, is proportional to the operation temperature. In an embodiment, the junction voltage difference, ΔVbe, satisfies:

$$\Delta V_{be} = \frac{kT}{q}\ln(n), \tag{2}$$

where n represents the ratio between the dimension of the transistor, Q2, and the size of the transistor, Q1, k represents the Boltzmann constant, T represents the operation temperature, and q represents the magnitude of the electrical charge on the electron, which is a constant equal to $1.602\times10^{-19}$. The OPAMP 312 forces the drain voltage of transistors, MP1, MP4, to be equal, such that the junction voltage difference ΔVbe is placed on the resistor, R1, generating a PTAT (positive to absolute temperature) current, "Iptat." The current, Iptat, is then mirrored through the transistors, MP4, MP5, to the resistor, R2, and the bipolar device, Q3, generating a reference voltage, Vref, at the output terminal 304 of the voltage reference circuit 302, which can be independent from the operating temperature. In one embodiment, the reference voltage, Vref, satisfies:

$$V_{ref} = V_{be} + I_{ptat} \times r_2 = V_{be} + \frac{r_2}{r_1}\frac{kT}{q}\ln(n), \tag{3}$$

where r1, r2 represent the resistances of the resistors, R1, R2. By choosing a proper ratio of the resistances of the resistors R1, R2, a temperature independent output, Vref, can be generated, which is typically close to 1.23V.

Figure 4:
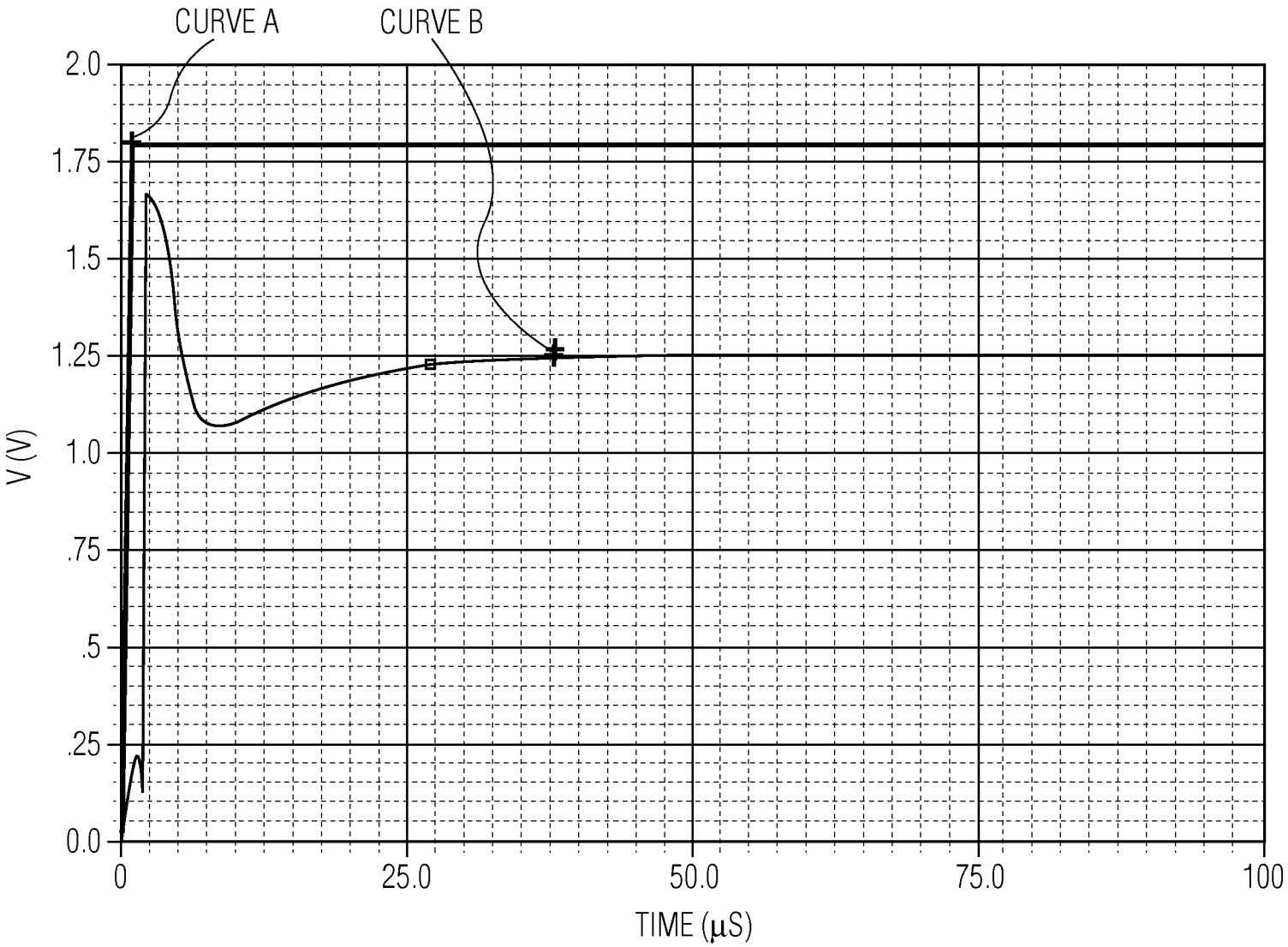
FIG. 4 is a diagram of an input voltage and an output reference voltage of the voltage reference circuit shown in FIG. 3.

Compared to conventional PNP bandgap circuits, the voltage reference circuit 302 starts up quicker and consumes less current. In one embodiment, the voltage reference circuit 302 starts up in about 370 and consumes a current of around 1 μA. FIG. 4 is a diagram of an input voltage and an output voltage of the voltage reference circuit 302. Specifically, curve "A" represents the input voltage of the voltage reference circuit 302 while curve "B" represents the output voltage of the voltage reference circuit 302. As indicated by curve A, the input voltage increases from zero to a stable voltage level of 1.8V in less than 2.5 μS. As indicated by curve B, the output voltage increases from zero to a stable voltage level of about 1.23V in around 36.88 μS.

Figure 5:
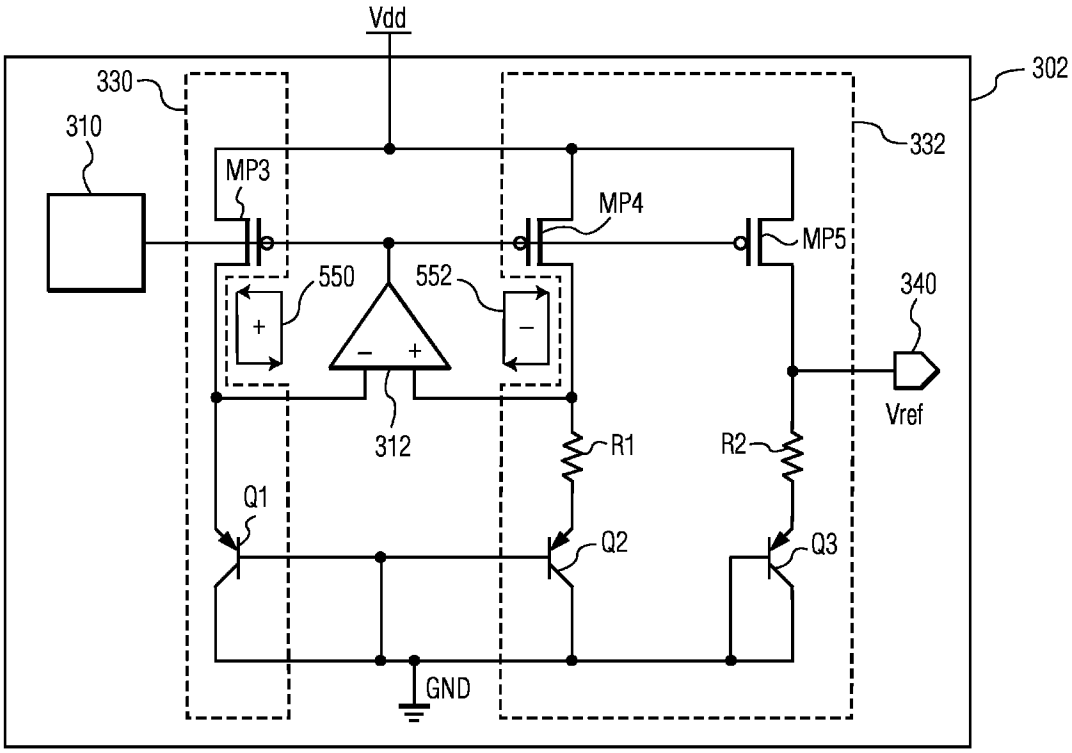
FIG. 5 shows feedback loops of the voltage reference circuit shown in FIG. 3.

The performance of an electric circuit that operates based on the reference voltage from the voltage reference circuit 302 is dependent on the stability of the reference voltage. For example, in an oscillator, the accuracy of the oscillation signals is largely dependent on the accuracy of a reference voltage and a reference current that corresponds to the reference voltage. If the reference voltage is unstable, the reference voltage can negatively affect the performance of an electric circuit that operates based on the reference voltage. The voltage reference circuit 302 is stable because the voltage reference circuit 302 has two feedback loops between the positive feedback OPAMP 312 and the startup circuit 310 and the PTAT current generator 314. FIG. 5 shows two exemplary feedback loops 550, 552 of the voltage reference circuit 302 of FIG. 3. One of the feedback loops is a positive feedback loop 550 between the OPAMP 312 and the first PTAT current generation section 330. The other one of the feedback loops is a negative feedback loop 552 between the OPAMP 312 and the second PTAT current generation section 332. The voltage reference circuit 302 is stable because the negative feedback gain is always larger than the positive feedback gain.

Figure 6:
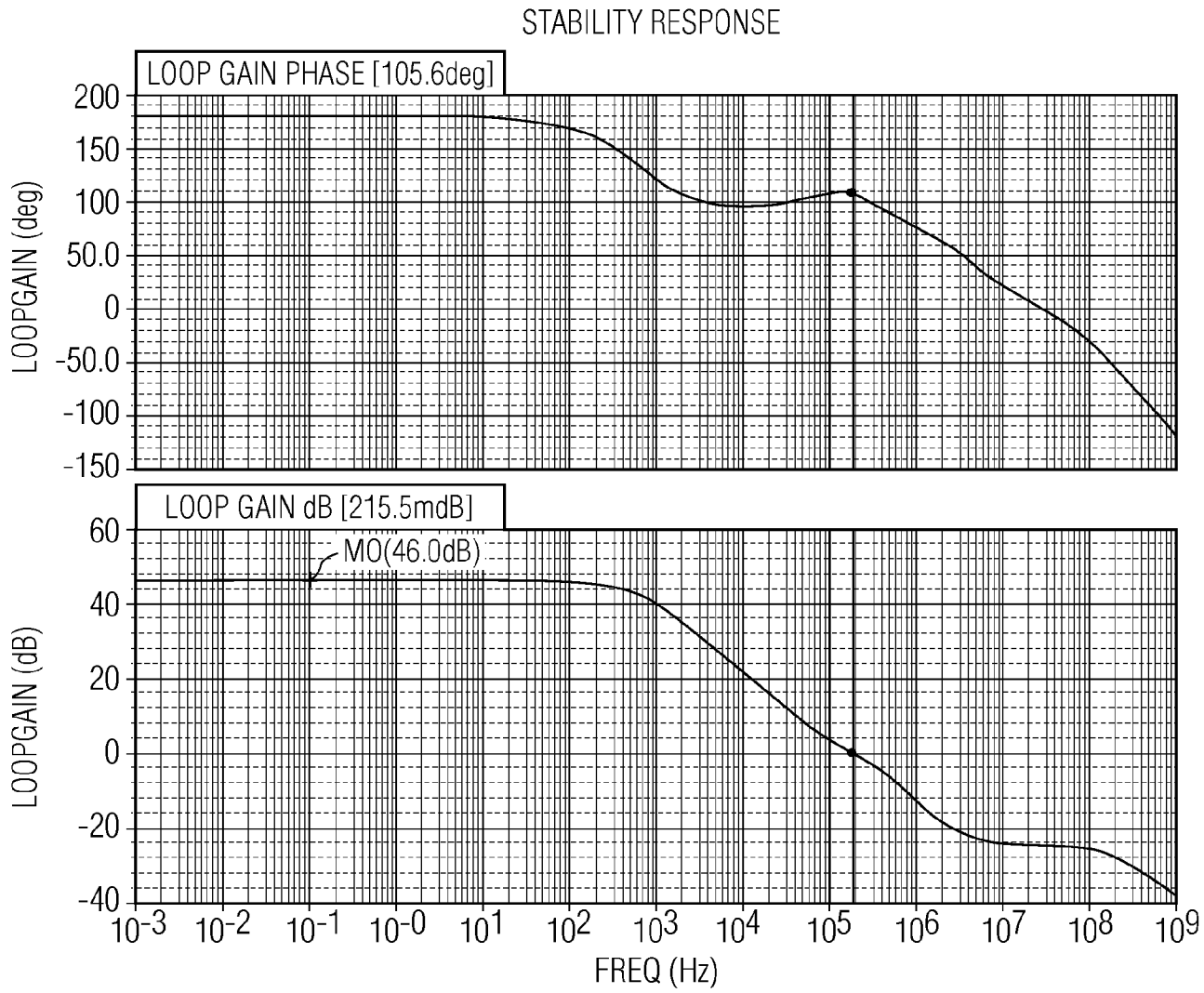
FIG. 6 is a diagram of a stability response of the voltage reference circuit shown in FIG. 3.

FIG. 6 is a diagram of a stability analysis of the voltage reference circuit 302. To perform the stability analysis, a probe component may be placed at the output of the OPAMP 312 for stability simulation. FIG. 6 includes a loop gain phase section (i.e., the upper section of FIG. 6) and a loop gain value section (i.e., the lower section of FIG. 6). The X-axis of the loop gain phase section represents the operating frequency of the voltage reference circuit 302 and the Y-axis of the diagram represents the loop gain in degree. The X-axis of the loop gain value section represents the operating frequency and the Y-axis of the diagram represents the loop gain in dB. As shown in FIG. 6, the stability point of the voltage reference circuit 302 is at a phase margin of 105.6 degrees and 46 dB. In the stability analysis of a circuit with a feedback loop, a minimum of 60 degrees of phase margin is required to guarantee that the circuit is stable without oscillation. A 105.6 degrees phase margin shows that the circuit is stable according to the stability theory. A reduction in noise of 46 dB means that a 0.2V noise at the power supply will be reduced to 0.8 mV at the output. This degree of noise reduction is sufficient to shield noise from a sensitive circuit such as a Phase Lock Loop (PLL) and an Analog-Digital-Converter (ADC).

Although specific embodiments of the invention that have been described or depicted include several components described or depicted herein, other embodiments of the invention may include fewer or more components to implement less or more feature.

In addition, although specific embodiments of the invention have been described and depicted, the invention is not to be limited to the specific forms or arrangements of parts so described and depicted. The scope of the invention is to be defined by the claims appended hereto and their equivalents.

What is claimed is:

1. A voltage reference circuit comprising:

a startup circuit configured to generate a startup current and to be turned off in response to a comparison between the startup current and a current threshold;

an amplifier connected to the startup circuit and configured to generate an amplified current using a positive current feedback loop in response to the startup current, wherein the amplifier includes an operational amplifier comprising:

a differential input stage connected to the startup circuit; and an output stage connected to the differential input stage, wherein the differential input stage and the output stage form the positive current feedback loop in which a spike in a current that flows through the differential input stage causes a further increase of the current beyond the spike; and a proportional to absolute temperature (PTAT) current generator configured to generate a temperature-independent reference voltage in response to the startup current and the amplified current.

2. The voltage reference circuit of claim 1, wherein the output stage includes a diode-connected transistor, and wherein a drain terminal of the diode-connected transistor is connected to a gate terminal of the diode-connected transistor.

3. The voltage reference circuit of claim 2, wherein the gate terminal of the diode-connected transistor is connected to gate terminals of a plurality of transistors of the PTAT current generator and a gate terminal of a transistor of the differential input stage.

4. The voltage reference circuit of claim 3, wherein the current that flows through the differential input stage is a bias current of the transistor of the differential input stage.

5. The voltage reference circuit of claim 3, wherein the PTAT current generator further includes a plurality of bipolar devices that are connected to the plurality of transistors of the PTAT current generator.

6. The voltage reference circuit of claim 2, wherein the drain terminal of the diode-connected transistor is directly connected to the gate terminal of the diode-connected transistor.

7. The voltage reference circuit of claim 1, wherein the differential input stage includes a differential input pair of transistors, and wherein a drain current of the differential input pair of transistors is exponentially related to a gate-source voltage difference of the differential input pair of transistors.

8. The voltage reference circuit of claim 1, wherein the startup circuit includes:

a current source configured to generate a source current when no current flows through the voltage reference;

a current comparator configured to generate the startup current in response to the source current; and a switch connected to the current comparator, wherein the current comparator is further configured to turn off the switch in response to the comparison between the startup current and the current threshold.

9. The voltage reference circuit of claim 8, wherein the current comparator includes a trigger transistor having a gate terminal that is connected to the switch, gate terminals of a plurality of transistors of the PTAT current generator, and gate terminals of a plurality of transistors of the amplifier.

10. The voltage reference circuit of claim 9, wherein the switch includes a transistor having a gate terminal that is connected to a source terminal or a drain terminal of the trigger transistor of the current comparator.

11. The voltage reference circuit of claim 8, wherein the current source includes a first set of transistors that is connected in series, wherein the current comparator includes a second set of transistors that is connected in series, and wherein the switch includes a switching transistor.

12. The voltage reference circuit of claim 11, wherein the second set of transistors includes a trigger transistor and at least one transistor connected to a drain terminal or a source terminal of the trigger transistor and a gate terminal of the switching transistor, and wherein a gate terminal of the trigger transistor is connected to a drain terminal or a source terminal of the switching transistor, gate terminals of a plurality of transistors of the PTAT current generator, and gate terminals of a plurality of transistors of the amplifier.

13. The voltage reference circuit of claim 1, wherein the voltage reference circuit is a bandgap circuit.

14. A voltage reference circuit comprising:

a startup circuit configured to generate a startup current and to be turned off in response to a comparison between the startup current and a current threshold, wherein the startup circuit includes:

a current source configured to generate a source current when no current flows through the voltage reference;

a current comparator configured to generate the startup current in response to the source current; and a switch connected to the current comparator, wherein the current comparator is further configured to turn off the switch in response to the comparison between the startup current and the current threshold;

an operational amplifier connected to the startup circuit and configured to generate an amplified current using a positive current feedback loop in response to the startup current, wherein the operational amplifier comprises:

a differential input stage connected to the startup circuit; and an output stage connected to the differential input stage, wherein the differential input stage and the output stage form the positive current feedback loop in which a spike in a current that flows through the different input stage causes a further increase of the current beyond the spike; and a proportional to absolute temperature (PTAT) current generator configured to generate a temperature-independent reference voltage in response to the startup current and the amplified current.

15. The voltage reference circuit of claim 14, wherein the output stage includes a diode-connected transistor, and wherein a drain terminal of the diode-connected transistor is directly connected to a gate terminal of the diode-connected transistor.

16. The voltage reference circuit of claim 15, wherein the current comparator includes a trigger transistor having a gate terminal that is connected to the switch, gate terminals of a plurality of transistors of the PTAT current generator, and gate terminals of a plurality of transistors of the operational amplifier.

17. A bandgap voltage reference circuit comprising:

a startup circuit configured to generate a startup current and to be turned off in response to a comparison between the startup current and a current threshold;

an operational amplifier connected to the startup circuit and configured to generate an amplified current using a positive current feedback loop in response to the startup current, wherein the operational amplifier comprises:

a differential input stage connected to the startup circuit; and an output stage connected to the differential input stage, wherein the differential input stage and the output stage form the positive current feedback loop in which a spike in a current that flows through the different input stage causes a further increase of the current beyond the spike; and a proportional to absolute temperature (PTAT) current generator configured to generate a temperature-independent reference voltage in response to the startup current and the amplified current.

18. The bandgap voltage reference circuit of claim 17, wherein the output stage includes a diode-connected transistor, wherein a drain terminal of the diode-connected transistor is directly connected to a gate terminal of the diode-connected transistor, wherein the gate terminal of the diode-connected transistor is connected to gate terminals of a plurality of transistors of the PTAT current generator and a gate terminal of a transistor of the differential input stage, and wherein the startup circuit includes:

a current source configured to generate a source current when no current flows through the voltage reference;

a current comparator configured to generate the startup current in response to the source current; and a switch connected to the current comparator, wherein the current comparator is further configured to turn off the switch in response to the comparison between the startup current and the current threshold.

19. The bandgap voltage reference circuit of claim 18, wherein the current comparator includes a trigger transistor having a gate terminal that is connected to the switch, the gate terminals of the plurality of transistors of the PTAT current generator, and gate terminals of a plurality of transistors of the operational amplifier.

* * * * *